US008113685B2

(12) United States Patent
Waumans et al.

(10) Patent No.: US 8,113,685 B2
(45) Date of Patent: Feb. 14, 2012

(54) LIGHTING DEVICE COMPRISING AT LEAST ONE LAMP AND AT LEAST ONE OLED

(75) Inventors: Lars Rene Christian Waumans, Eindhoven (NL); Lingli Wang, Bad Kreuznach (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 273 days.

(21) Appl. No.: 12/523,536

(22) PCT Filed: Jan. 16, 2008

(86) PCT No.: PCT/IB2008/050154

§ 371 (c)(1),
(2), (4) Date: Jul. 17, 2009

(87) PCT Pub. No.: WO2008/090492

PCT Pub. Date: Jul. 31, 2008

(65) Prior Publication Data

US 2009/0303705 A1 Dec. 10, 2009

(30) Foreign Application Priority Data

Jan. 24, 2007 (EP) ..... 07101076
Feb. 13, 2007 (EP) ..... 07102205

(51) Int. Cl.
*F21S 19/00* (2006.01)

(52) U.S. Cl. ..... 362/228; 362/249.02

(58) Field of Classification Search ..... 362/227, 362/228, 249.01, 249.02
See application file for complete search history.

(56) References Cited

U.S. PATENT DOCUMENTS

| | | | | |
|---|---|---|---|---|
| 6,688,753 | B2 | 2/2004 | Calon et al. | |
| 7,614,767 | B2 * | 11/2009 | Zulim et al. | 362/296.01 |
| 2001/0000005 | A1 | 3/2001 | Forrest et al. | |
| 2005/0024339 | A1 | 2/2005 | Yamazaki et al. | |
| 2005/0225986 | A1 | 10/2005 | Holten et al. | |
| 2005/0237766 | A1 | 10/2005 | Klettke | |
| 2005/0265023 | A1 | 12/2005 | Scholl | |

FOREIGN PATENT DOCUMENTS

| | | | |
|---|---|---|---|
| EP | 1120600 | A1 | 8/2001 |
| WO | 9953236 | A1 | 10/1999 |
| WO | 03048634 | A1 | 6/2003 |
| WO | 2005086257 | A1 | 9/2005 |

OTHER PUBLICATIONS

Fujita et al: "Organic Light-Emitting Diode With ITO/Organic Photonic Crystal"; Electronic Letters, vol. 39, No. 24, Nov. 27, 2003, 2 Page Document.

Patel et al: "High-Efficiency Orgfanic Light-Emitting Diodes"; IEEE Journal on Selected Topicvs in Quantum Electronics, vol. 8, No. 2, Mar./Apr. 2002, pp. 346-361.

* cited by examiner

*Primary Examiner* — John A Ward
(74) *Attorney, Agent, or Firm* — Mark L. Beloborodov

(57) ABSTRACT

The invention provides a lighting device comprising at least one lamp and at least one OLED which are arranged to generate light, wherein the at least one OLED is arranged to transmit at least part of the light generated by the at least one lamp. The lighting device of the invention may advantageously provide the option of providing two types of light, namely, "normal" of the lamp, which can be used for e.g. illumination purposes, and OLED light of the OLED, which can be used for lumination purposes.

13 Claims, 10 Drawing Sheets

LIGHTING DEVICE COMPRISING AT LEAST ONE LAMP AND AT LEAST ONE OLED

FIELD OF THE INVENTION

The present invention relates to a lighting device comprising at least one lamp and at least one OLED.

BACKGROUND OF THE INVENTION

Lighting devices or lamp systems comprising different light sources are known in the art. For instance, U.S. Pat. No. 6,688,753 describes a lighting device comprising a first lighting element, preferably a compact fluorescent discharge vessel, and a second lighting element preferably comprising a plurality of LEDs. During operation, the first lighting element has a comparatively high light output. In operation, the second lighting element has a light output which is relatively low in comparison with that of the first lighting element. The first or the second lighting element, or both can be switched on. The lighting device allows remote-controlled switching between orientation light (night lamp) and normal light, using a toggle function in the lighting device.

US 2005/0265023 also describes a hybrid system for illumination, comprising a gas discharge lamp with a color point in the green-blue, a LED with a color point in the yellow-red, and an optical component for additive mixing of the light from the gas discharge lamp and the LED. A blue and green emitting fluorescent lamp is particularly suitable as a gas discharge lamp, and a red-yellow emitting AlGaInP LED or a red-emitting AlGaAs LED as a LED. Through additive mixing of the light from these high-efficiency light sources, US 2005/0265023 provides a highly efficient light source affording good color rendering, which contains the three primary colors and is particularly suited to the highly efficient generation of white light.

OBJECT AND SUMMARY OF THE INVENTION

These prior-art lamps have one or more drawbacks of being unable to provide a lamp with two (separate) beams, for instance, one for illuminating objects and the other having a luminance function, or they have a complicated or voluminous construction.

It is an object of the invention to provide an alternative lighting device, which preferably further obviates one or more of the above-mentioned drawbacks. In a specific embodiment, it is an object of the invention to provide a lighting device in which the at least one lamp and the at least one OLED provide beams of light which may leave the device at different angles.

In accordance with a first aspect of the invention, a lighting device comprises (a) at least one lamp which is arranged to generate light and (b) at least one OLED which is arranged to generate light, wherein the at least one OLED is arranged to transmit at least part of the light generated by the at least one lamp.

In a specific embodiment, a lighting device according to the invention further comprises a beam manipulator which is arranged to manipulate at least part of the light of the at least one lamp and illuminate at least part of the at least one OLED with manipulated light. The OLED transmits at least part of the (manipulated) light generated by the lamp.

In yet another specific embodiment, the invention provides a lighting device wherein the lamp and the beam manipulator are arranged to manipulate the light of the at least one lamp into a beam, and the at least one OLED is arranged to provide light substantially outside the beam of the (manipulated) lamp light.

In a specific embodiment, the invention provides a lighting device wherein the at least one lamp is arranged to generate light into a first beam and the at least one OLED is arranged to generate light into a second beam, wherein, relative to a normal to the at least one OLED, the first beam has a cut-off angle $\beta\mathbf{1}$ and the second beam has a cut-off angle $\gamma\mathbf{2}$ and optionally a cut-off angle $\gamma\mathbf{1}$, and wherein $\gamma\mathbf{2}>\gamma\mathbf{1}$ and preferably $\gamma\mathbf{2}\geqq\beta\mathbf{1}$.

The lighting device of the invention may advantageously allow the option of providing two types of light, "normal" of the lamp, which can be used, for instance, for illumination purposes, and OLED light of the OLED, which can be used for lumination purposes.

Furthermore, embodiments of the lighting device according to the invention may fulfill (at the same time) the functions of, for instance, an illuminance system for e.g. general shop-lighting, and a luminance system for e.g. indication lighting. For instance, in a shop, the lighting device may provide general lighting by the lamp and lumination light, depending on the types of goods presented in a specific part of the shop. The two types of light generated by the lighting device according to the invention may also be used to give color effects. Furthermore, the lighting device of the invention may also provide the functions of orientation light (night light) or escape indication (OLED) and illumination (lamp). These multiple functions may be executed at the same time or consecutively. Other embodiments enable the lighting device to provide light having a "corona" effect.

The lighting device according to the invention has the further advantage that relatively small devices may be constructed and, as mentioned above, more functions can be combined in one lighting device.

BRIEF DESCRIPTION OF THE DRAWINGS

Embodiments of the invention will now be described, by way of example only, with reference to the accompanying schematic drawings in which corresponding reference symbols indicate corresponding parts.

DESCRIPTION OF EMBODIMENTS

Figure 1:
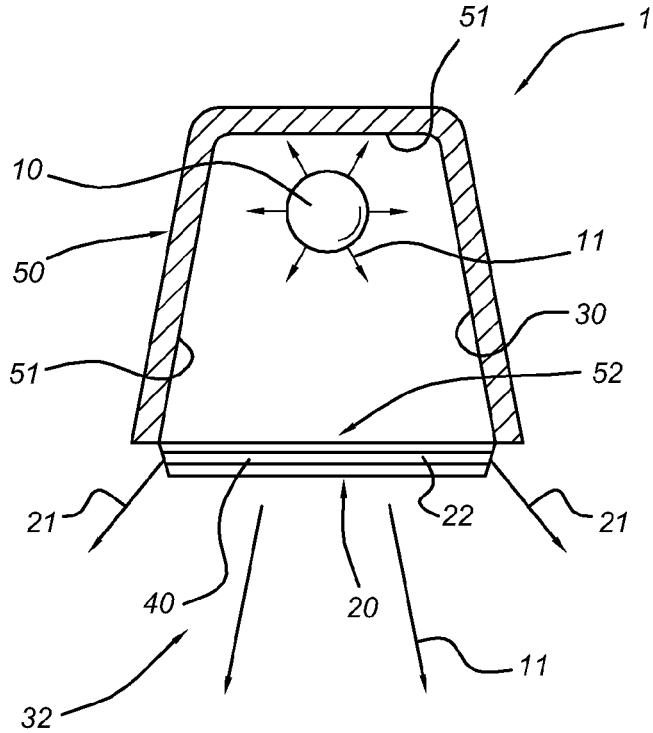
FIG. 1 is a schematic side view of an embodiment of the lighting device of the invention, such as a downlight or TL luminaire.

Referring to FIGS. 1, 4 to 7, and 9, the present invention provides a lighting device 1 comprising:

(a) at least one lamp 10 (also indicated as source 10) which is arranged to generate light 11; and (b) at least one OLED 20 (also indicated as source 20) which is arranged to generate light 21, wherein the at least one OLED 20 is arranged to transmit at least part of the light 11 generated by the at least one lamp 10. As can be seen in the Figure(s), the at least one lamp 10 is arranged to illuminate (or irradiate) at least part of the at least one OLED 20, which (during operation of the device 1) transmits at least part of the light 11 generated by the at least one lamp 10.

The light generated by device 1, i.e. the light generated by both sources 10 and 20, is denoted by reference numeral 32. The light generated by the two sources 10, 20 may be separated substantially angularly, as is especially indicated in FIGS. 2 to 5, but may also substantially overlap, as is indicated, for instance, in FIG. 6. Hence, in embodiments, light 32 generated by lighting device 1 may comprise two or more beams which may be angularly separated. The term "angularly separated" refers to the situation in which an observer can distinguish different beams dependent upon the viewing angle.

The individual light sources 10, 20 of the lighting device 1 will first be described in general below, and embodiments of the lighting device 1 will then be described in more detail.

The Light Sources (Lamp 10 and OLED 20)

The at least one lamp 10 may comprise one or more lamps selected from the group of filament lamps, fluorescent lamps (especially tubular luminescent (TL) lamps and compact fluorescent lamps (CFL)), halogen lamps, low-pressure gas discharge lamps, high-pressure gas discharge lamps, LEDs, and optionally also OLEDs. The at least one lamp 10 is preferably suitable for illumination purposes, ranging from low-flux applications for consumer use, typically at more than about 50 Lm (lumen), via about 3000 Lm application in office lighting to high-flux applications as used in industry and stadium lighting, where the flux per lighting device can exceed about 5000 or even 10,000 Lm. Hence, the at least one lamp is able to provide a luminous flux (further indicated as flux) of light selected from the range of about 25 to 20,000 Lm. In an embodiment, the at least one lamp 10 has a variable flux. Lamp 10 preferably comprises one or more lamps selected from the group of low-pressure gas discharge lamps (CFL, TL) and LEDs. Herein, the term "LED" or "LEDs" (light-emitting diode or diodes) does not include an OLED or OLEDs (organic light-emitting diode or diodes). The lamps 10 described herein may be lamps known to the person skilled in the art.

The term "at least one lamp" includes embodiments wherein more than one lamp is used, i.e. a plurality of lamps, for instance, a number of LEDs, such as two or more LEDs or a system of two fluorescent lamps with different color temperatures (as described in, for instance, US2005/0225986 or WO2003048634). Herein, the notation "lamp" also indicates "at least one lamp". Hence, the terms "at least one lamp" or "lamp" refer to one or more lamps.

The at least one OLED 20 may comprise one or more OLEDs. Herein, the notation "OLED" also indicates "at least one OLED". Hence, the terms "at least one OLED" or "OLED" refer to one or more OLEDs, i.e. a plurality of OLEDs.

OLED performance has improved with time and is expected to improve even further in the future to a level at which they can even be applied in illuminance lighting devices. Nowadays, OLEDs can already be applied in luminance applications. In comparison with other light sources, OLEDs have unique features such as flatness, flexibility, and transparency when they are off and in operation. Generally, the performance of most commercially available OLEDs does not yet meet the illuminance standard. This may still stand in the way of applying OLEDs (now commercially available) on the general lighting market, but this may be different in the near future. They are, however, perfectly suited for luminance effects.

OLEDs are known in the art. However, for the sake of understanding, an embodiment of such OLEDs will herein be described schematically. Two types of OLEDs can be distinguished:

OLEDs in which the active layer is a polymer (PolyLeds); and

OLEDs in which the active layer is a Small molecule (SmOLEDs).

The OLED device consists of an active layer, a cathode, an anode and a substrate. The active organic layers consist of a hole transport layer (for instance, about 100 nm) and the light-emitting polymer (for instance, about 80 nm) for the polymer-based organic LED. The small-molecule version of an organic LED consists of some more layers: hole injecting, emitting, hole blocking and electron transport layer. The emitting OLED layer is a hydrocarbon-based structure, for instance, manufactured by well-known suppliers, such as Kodak, Mitsubishi and Konica Minolta. The OLED active layer is mounted on a substrate which may be sputtered with, for instance, indium tin oxide (ITO), thereby forming an ITO layer of about 150 nm to function as a hole-injecting electrode. The cathode applied on top of the organic layers may ensure that electron injection is of the order of 100 nm. When the substrate and both the cathode and anode material are chosen from the transparent conductor oxide group of materials, e.g. an ITO type of material, a transparent device can be constructed. Overall, the complete stack in both organic LEDs does not generally exceed about 200 nm. The devices can be encapsulated by means of thin-film encapsulation which, in total, may form an additional layer of about 10 μm (about 0.6 μm of actual barrier and several μms of additional protective coating). The thickness of a device is therefore mainly determined by the substrate thickness. In the case of glass encapsulation, the minimum thickness used is about 0.4 mm which is roughly four times the thickness of 80 gram/$m^2$ paper often used in printed matter. Nowadays, the area can be extended to page-like dimensions. The performance of state-of-the-art emitting polymers is improving rapidly. The brightness level of the OLED can be adjusted by changing the current/voltage settings of the power source, as OLEDs are current-driven. All this is known in the art.

White emitting OLEDs are known to have a brightness of about 50 Cd/$m^2$: 3 V, 3 mA/$cm^2$ (1.5 lum), efficiencies of 12 Cd/A have been reported for small-molecule devices.

The at least one OLED 20 preferably generates light with a saturated color (i.e. a purity of at least 70%). This is useful for indication. Alternatively, also a stack of OLEDs with different colors can be used, which may result in a tunable indication color of the luminaire (see also below).

Figure 2A:
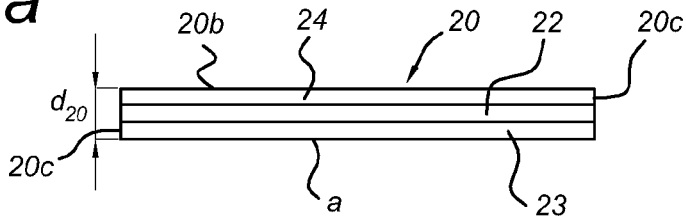
FIGS. 2*a*-2*d* schematically depict in more detail the OLED and a window pane comprising the OLED, respectively, for use in the lighting device of the invention.

FIG. 2*a* schematically depicts an OLED 20 with an organic layer 22 sandwiched between a first layer 23 and a second layer 24, which layers comprise the above-mentioned substrate or substrates and/or electrodes, etc., as known in the art. The details of the substrate or substrates and anode or anodes/cathode or cathodes, etc. are not further described or depicted, see also above. This is known in the art, see e.g. M. Fujita et al., Electronics Letters, 27 Nov. 2003, vol. 39 (24) or N. K. Patel et al., IEEE Journal on selected topics in quantum electronics, vol. 8 (2), March/April 2002, pages 346-361. The thickness $d_{20}$ of the OLED 20, including a substrate, is generally in the range of about 0.3 to 20 mm.

In general, prior-art OLED devices further comprise specific structures at one or more of the interfaces of organic layer/ITO layer-substrate and substrate-air. These structures are necessary to couple the light generated in the organic layer 22 (efficiently) out of the OLED 20, see e.g. also Patel et al., who describe structures such as surface roughness, silica microspheres, microlenses, etc. Other structures for improving outcoupling of the light are also possible. When these structures are present at both sides of the organic layer 22, and transparent electrodes/substrates are used, light is emitted in both directions relative to the organic layer (in FIG. 2*a*, OLED light would escape from faces 20*a* and 20*b*); when such structures are only arranged at one side (i.e. at face 20*a* or face 20*b*), and, for instance, a reflective layer is present at the other side, light generated in the organic layer is substantially emitted in one direction (in FIG. 2*b*, OLED light would escape from faces 20*a* or 20*b*). In a preferred embodiment, these structures are absent, at least at the above-mentioned interfaces, see also below. Hence, in an embodiment, no structures are provided to enhance the output coupling from OLED light from face 20*a* and/or face 20*b*. Faces 20*a* and 20*b* are external surfaces of the OLED (i.e. of first layer 23 and second layer 24, respectively) which are arranged in parallel with the organic layer 22, as known in the art.

The OLEDs used herein are transparent. Transparent OLEDs have only substantially transparent components (substrate, cathode and anode) and, when turned off, are preferably at least 50% transparent, preferably at least about 70%, more preferably at least up to about 85% or more. When the transparent OLED is turned on, it allows light to pass in both directions. The OLEDs used in the invention are preferably at least 50% transparent to the visible light 11 generated by the at least one lamp 10, especially when (one or more of the) at least one OLED is switched on (is in operation), and preferably at least about 70%, more preferably at least 85% transparent. Here, the phrase "at least 50% transparent" means that the transmission throughout the visible wavelength range (i.e. within the range of 380-780 nm) of the light 11 generated by the at least one lamp 10 will be transmitted for at least 50% by the at least one OLED 20 when the OLED 20 is in operation and when assuming perpendicular irradiation with such light 11.

Figure 6:
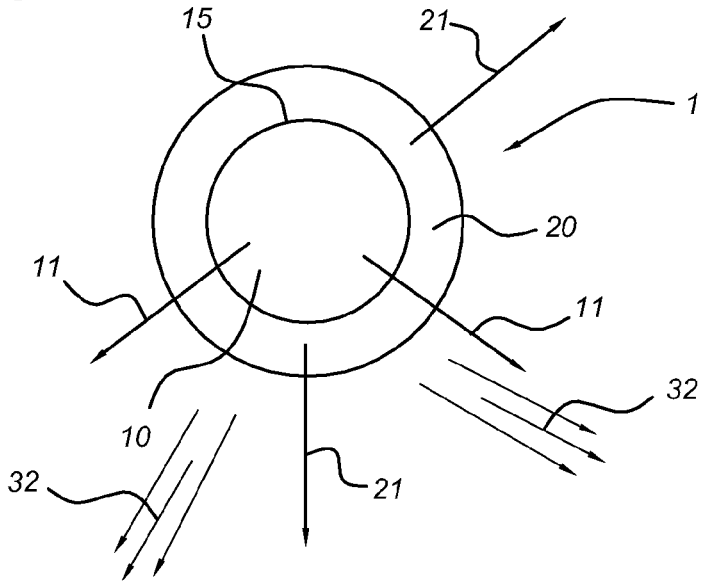
FIG. 6 is a schematic top view of another embodiment of the lighting device of the invention.

OLEDs may be foldable, which is of special relevance for application on curved surfaces, as depicted in FIG. 6 (see also below) or bent surfaces. Foldable OLEDs have substrates, cathodes, anodes, etc. made of flexible metallic foils or plastics. Foldable OLEDs are known in the art.

The term "light" herein especially refers to visible radiation (VIS), i.e. radiation in the range of about 380-780 nm. In an embodiment, the light generated by the one or more lamps 10 or by the one or more OLEDs 20 comprises white radiation (i.e. white light), although in another embodiment one or more of these light sources 10, 20 may also produce colored light. Commercially available lamps 10 and transmissive OLEDs 20 emitting (white) light may be used. When the at least one lamp 10 comprises more than one lamp, such as a plurality of LEDs, or when the at least one OLED 20 comprises more than one OLED, the respective lamps or respective OLEDs may generate radiation of different colors. For instance, a set of blue, green and red LEDs may be used as lamp 10. When such multiple sources with multiple colors (of the generated light) are used as lamp 10, these sources are preferably arranged to be able to generate white light (by color mixing).

The Lighting Device 1

As mentioned above, the at least one OLED 20 is arranged to transmit at least part of the light 11 generated by the at least one lamp 10. In the device 1, the at least one lamp 10 is arranged to illuminate at least part of the at least one OLED 20. Due to the fact that the OLED 20 is transmissive, at least part of the light 11 generated by the at least one lamp 10 is transmitted by the at least one OLED 20. Such a configuration, as schematically depicted in, for instance, the embodiments of FIGS. 1 and 4 to 7, allows a relatively compact arrangement of the two sources 10, 20.

The embodiment of the lighting device 1 in FIGS. 1, 4, 5 and 7 further comprises a housing 50. The housing 50 has at least one opening 52 (or window), through which light 11 of the at least one lamp 10 can escape from the interior of the housing. In a further embodiment, the lighting device 1 has only one opening 52, arranged to allow light 11 to escape from the lighting device 1, i.e. housing 50 has only one opening 52. The lamp 10 is circumferentially arranged in housing 50. The embodiments schematically depicted in FIGS. 1, 4, 5 and 7 especially refer to side views of downlight lighting devices or TL office lighting devices. The term "downlight" is known to the person skilled in the art and generally refers to a luminaire in which most of the light is directed downwards, in particular to a floor or the ground. The lighting device 1 may also be termed luminaire.

The opening 52 may comprise the at least one OLED 20. For instance, the one or more OLEDs 20 may be arranged within opening 52 or at one side of this opening 52. In FIG. 1, the at least one OLED 20 is arranged substantially at one side of the opening 52, but as will be clear to the person skilled in the art, the shape of housing 50 and opening 52 may have any geometry, and concomitantly, the arrangement of the at least one OLED 20 in the lighting device 1 may be chosen by the person and/or designer skilled in the art, on condition that at least part of the light 11 of the at least one lamp 10 irradiates the at least one OLED 20 (which transmits at least part of this light 11). The at least one OLED 20 may be integrated within, in front of or behind opening 52 in any way known to the person skilled in the art. Hence, the at least one OLED 20 will at least partly be arranged as a kind of window pane (denoted by reference numeral 40), through which at least part of the light 11 of lamp 10 will be transmitted. This window pane 40 may be the (at least one) OLED 20, or it may be a transmissive material wherein and/or whereon the at least one OLED 20 is arranged (see also below). In either case, when the OLED is in operation, the transmission of the window pane 40 for the visible light 11 of the at least one lamp 10 is at least 50%, preferably at least 70%, more preferably at least 85%, assuming perpendicular irradiation (see also above).

The lighting device 1 according to the invention may further comprise one or more beam manipulators 30 arranged to manipulate at least part of the light 11 of the at least one lamp 10 and illuminate at least part of the at least one OLED 20 with manipulated light. The beam manipulator 30 may comprise one or more devices selected from the group of reflectors and collimators. Due to the geometry of the lighting device 1 (especially housing 50 and the arrangement of the at least one lamp 10 relative to housing 50) and/or the beam manipulator 30, light 11 leaves the device 1 as beam 18.

The housing 50 preferably further comprises an at least partly reflective wall 51, also indicated as reflector or reflectors 51, as beam manipulator 30. Reflective elements or reflective coatings or layers are known to the person skilled in the art. At least part of the internal wall of housing 50 is preferably reflective. More preferably, substantially the whole internal wall of the housing 50 that receives light 11 from the at least one lamp 10 comprises reflective wall 51. In this way, light 11 of the at least one lamp 10 is substantially collimated on opening 52 (i.e. on at least part of the at least one OLED 20). Hence, in these Figures, beam manipulator 30 comprises a reflective layer, coating or element, which at least partially encloses the at least one lamp 10 and is arranged to manipulate at least part of the light 11 of the at least one lamp 10 (into a beam 18).

The beam manipulator 30 may also comprise a collimator. For instance, lamp 10 may comprise one or more LEDs having one or more collimators to collimate the light of the one or more LEDs. Each LED may have one collimator, respectively, but a plurality of LEDs may also have one collimator. LEDs with collimators or sets of LEDs with collimators are known in the art.

Hence, in a specific embodiment, the invention provides a lighting device 1 further comprising (at least one) beam manipulator 30 which is arranged to manipulate at least part of the light 11 of the at least one lamp 10 and illuminate at least part of the at least one OLED 20 with the manipulated light 11. The transparent OLED or OLEDs transmit at least part of the light 11 collimated by beam manipulator or manipulators 30 and illuminated by this (collimated) light. In these embodiments, the at least one OLED 20 is arranged within, in front of or behind opening 52, such that the manipulated light 11 of the at least one lamp 10 illuminates the at least one OLED 20 and through which at least part of the manipulated light 11 is transmitted. In an embodiment, preferably at least 40%, more preferably at least 70%, more preferably at least 90% of total flux of the light 11 of the at least one lamp 10 illuminates the at least one OLED 20 (see further also below). As will be clear to the person skilled in the art, one or more of the geometries of the housing 50, including the opening 52, the arrangement of the at least one lamp 10 relative to housing 50 and the optional presence of one or more beam manipulators 30, direct at least part of the total flux (preferably at least 40%) of the light 11 of the at least one lamp 10 towards the at least one OLED 20 (comprised in opening 52), and beam 18 is generated.

In FIGS. 1, 4, 5 and 7, the opening 52 comprises window pane 40, which is at least partially transparent to light 11 of lamp 10. The window pane 40 may consist of one or more OLEDs 20, i.e. window pane 40 is the at least one transparent OLED as described herein, or window pane 40 may comprise one or more transparent OLEDs, for instance, arranged in or on a glass plate (see below). Hence, the term "window pane" refers to a transparent device such as a plate, which is arranged within, in front of or behind opening 52 and comprises the one or more OLEDs 20. The window pane 40 is preferably flat, although in an embodiment also a curved window pane 40 may be applied. The preferred embodiments herein depicted schematically (FIGS. 1, 4, 5, and 7) comprise substantially flat window panes 40. Hence, in a specific embodiment, the at least one lamp 10 is arranged in a beam manipulator 30 which is arranged at least partially circumferentially and further comprises window pane 40 which comprises the at least one OLED 20. The window pane 40 is arranged to transmit at least part of the light 11 from lamp 10.

Window pane 40 may be, for instance, a glass plate or a transparent plastic or any other substantially transparent material, on or in which the at least one OLED 20 is arranged. For instance, especially when the OLED 20 is not foldable, for instance, in cases where the substrate is made of glass, window pane 40 may be the one or more OLEDs 20.

Figure 2B:
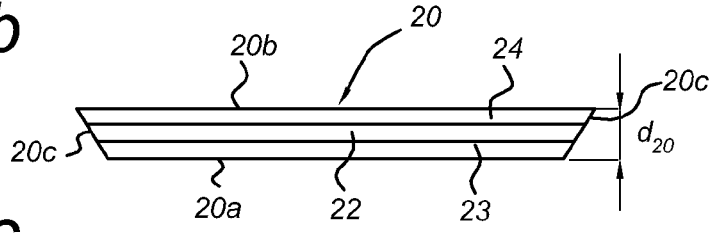
Figure 2C:
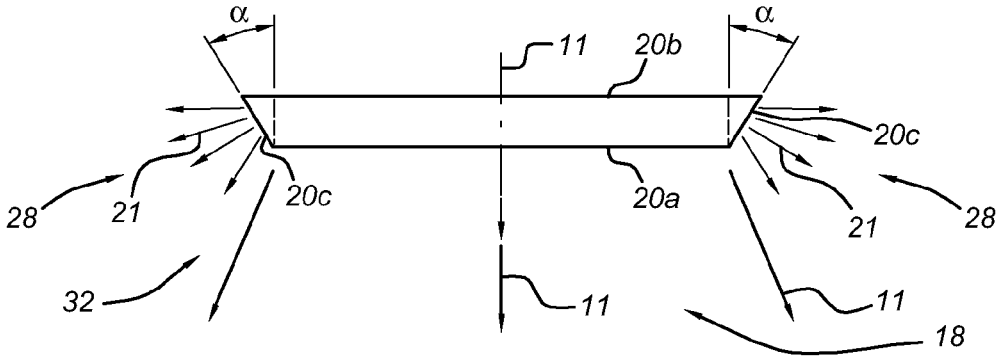
Figure 2D:
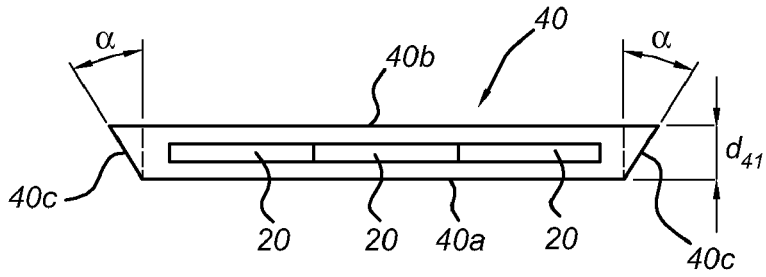

However, in another embodiment, as schematically depicted in FIG. 2*d*, the one or more OLEDs may also be comprised in a sheet, for instance, glass (the OLED or OLEDs 20), or may be sandwiched between glass plates or transparent plastic.

The window pane 40 has a thickness $d_{40}$ which is in the range of $d_{20}$ (when the window consists of one or more OLEDs) to about 20 mm (when the window comprises a transparent plate wherein and/or whereon the OLED or OLEDs are arranged), such as about 0.3-20 mm, although a larger thickness is also possible. When more OLEDs of different colors are used in one luminaire, they can be arranged on top of or next to each other.

Transparent materials which can be used to incorporate the OLED (for instance, in a sandwich structure), and/or on which the OLED may be applied, may be selected from, for instance, the group of glass, polymethyl acrylate (PMA), polymethyl methacrylate (PMMA) (Plexiglas or Perspex), cellulose acetate butyrate (CAB), polycarbonate, polyvinyl chloride (PVC), polyethylene terephthalate (PET), and glycol modified polyethylene terephthalate (PETG), which materials may be provided as transparent sheets. In another embodiment, the sheet material comprises an acrylate, for instance, PMA or PMMA, especially PMMA. Such materials are also known in the art as transparent plastics. In yet another embodiment, the sheet comprises transparent plastics commercially known as PERSPEX™ or PRISMEX™. Other substantially transparent materials known to the person skilled in the art may also be used. Combinations of two (or more) materials may be used.

The embodiments as schematically depicted in FIGS. 1, 4, 5 and 7 may have the specific advantage that a lighting device 1 can be provided which is arranged to provide two beams, one beam substantially comprising light 21 generated by the one or more OLEDs 20, and one beam substantially comprising light 11 generated by the one or more lamps 10. The OLED 20 is a Lambertian radiator, emitting light to all directions. This means that, especially with the current OLED performance, in the beam of the traditional lamp, the OLED 20 may have a relatively low flux in comparison with the flux of a "traditional" lamp, and may even not be perceivable by an observer. Outside the beam of the traditional lamp, the OLED light will become visible and luminance indication lighting, etc. can be obtained.

In the embodiments schematically depicted in FIGS. 1, 4, 5 and 7, a lighting device 1 is provided, wherein the lamp 10 and the optional beam manipulator 30 are arranged to manipulate light 11 into a beam 18 and the at least one OLED 20 may be arranged to provide light 21 substantially outside the beam 18. The term "substantially outside the beam 18" herein refers to the situation in which the cut-off angles (see also below) at which these beams 18 and 28 leave lighting device 1 substantially do not coincide. In this way, a lighting device 1 may be provided wherein the at least one lamp 10 and the at least one OLED 20 provide beams of light 18, 28 which are separated substantially angularly and thus leave the device 1 at different angles. For instance, this may be due to the fact that beam 18 substantially leaves the lighting device 1 at one or more positions spatially separated from positions where beam 28 substantially leaves the lighting device 1. Alternatively, or in combination with the above, this may also be due to the fact that beam 18 substantially leaves the lighting device 1 at angles different from angles at which beam 28 substantially leaves the lighting device 1.

This is further elucidated with reference to FIGS. 2*a* to 3*h*. FIGS. 2*a* to 3*h* schematically illustrate how this can be achieved in embodiments of the invention. The result is shown in FIGS. 3*b* to *d*, 3*f* to *h*, and in the schematic FIGS. 2*c*, 4 and 5. As mentioned above, the OLED 20 has a first face 20*a* and a second face 20*b*, which are substantially parallel to the organic layer 22. As mentioned above, prior-art OLEDs generally have structures to promote coupling of light (from the organic layer) out of the device, i.e. from first face 20*a*, or second face 20*b*, or from both faces 20*a* and 20*b*, for instance, in the direction perpendicular to faces 20*a* and/or 20*b*. Furthermore, the device 20 has edges 20*c*, substantially perpendicular to faces 20*a* and 20*b*. Edges 20*c* may refer to one or more edges 20*c*. Edges 20*c* are the edges of the device 20 which are arranged substantially perpendicularly to the organic layer; edges 20*a* and 20*b* are the external faces of the first and the second layer, respectively, which are substantially parallel to the organic layer 22 in OLED 20; i.e. the front and back face, respectively, of the OLED 20.

Figure 3A:
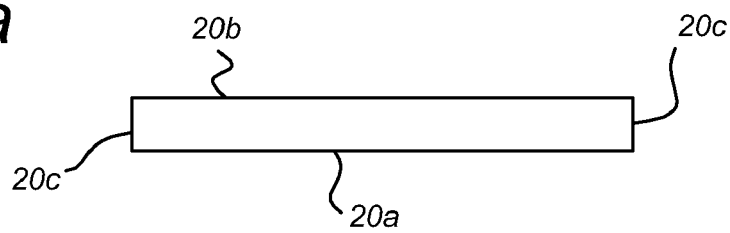
FIGS. 3*a*-3*h* schematically depict embodiments of the OLED and ray-tracing figures.
Figure 3B:
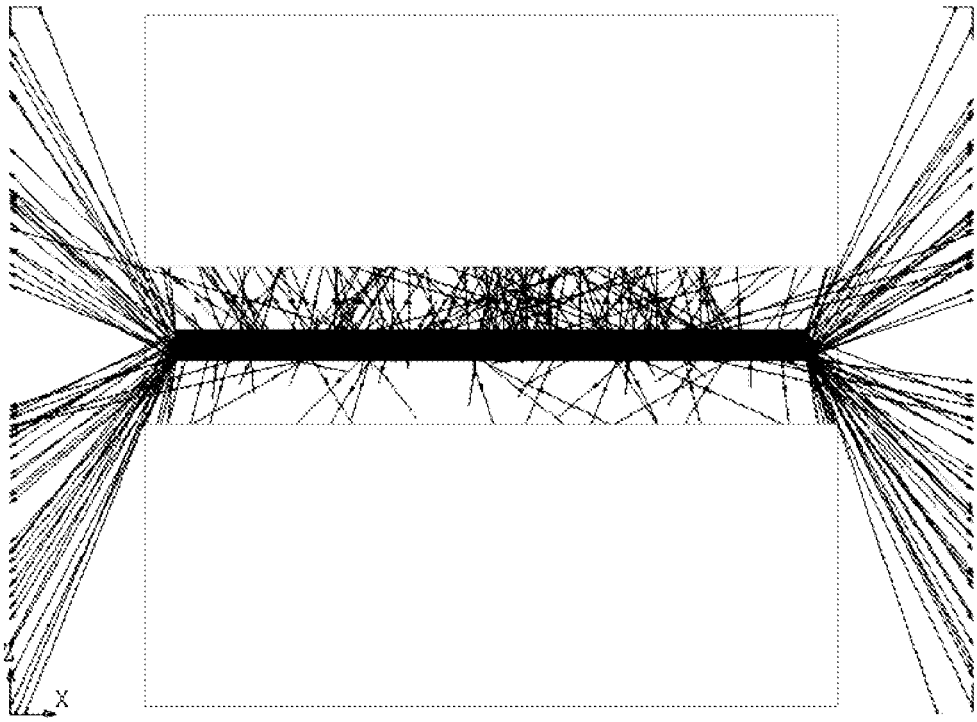
Figure 3C:
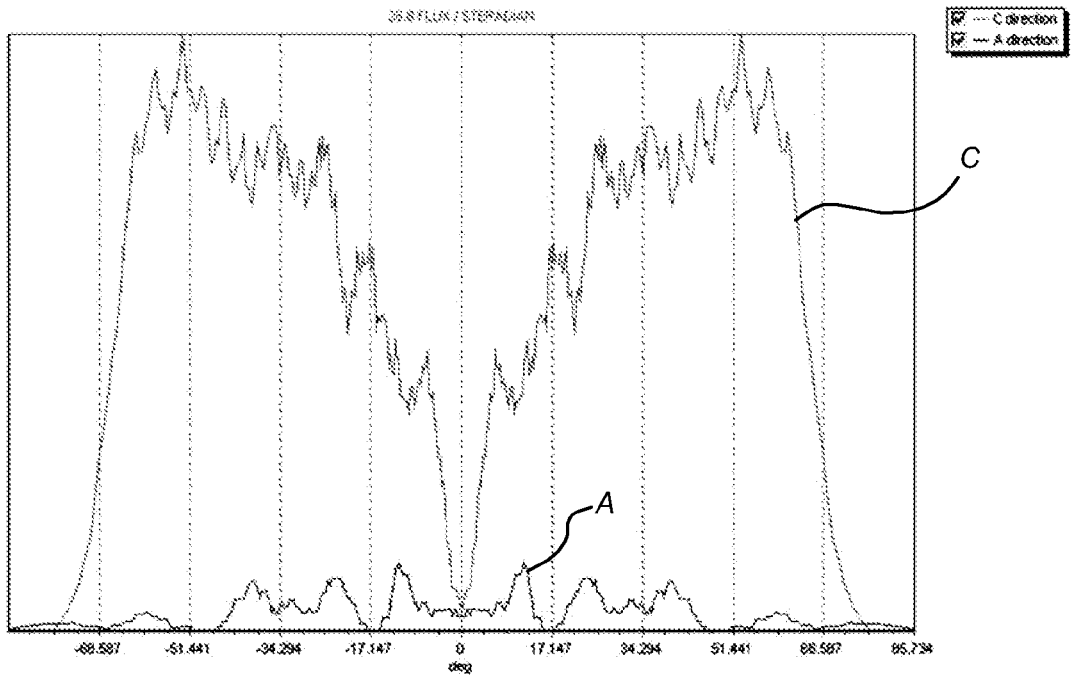

However, in the invention, also due to the preferred absence of structures for improving outcoupling of light at one or more of the interfaces 22-24, 22-23, 24-outside or 23-outside, light 21 will leave the OLED 20 at all surfaces 20*a*, 20*b* and 20*c*, but preferentially at the side surfaces or edges 20*c*. This is indicated in FIGS. 3*a*, 3*b* and 3*c*. A commercially available optical ray-tracing program is used to simulate the OLEDs 20 output.

Figure 3D:
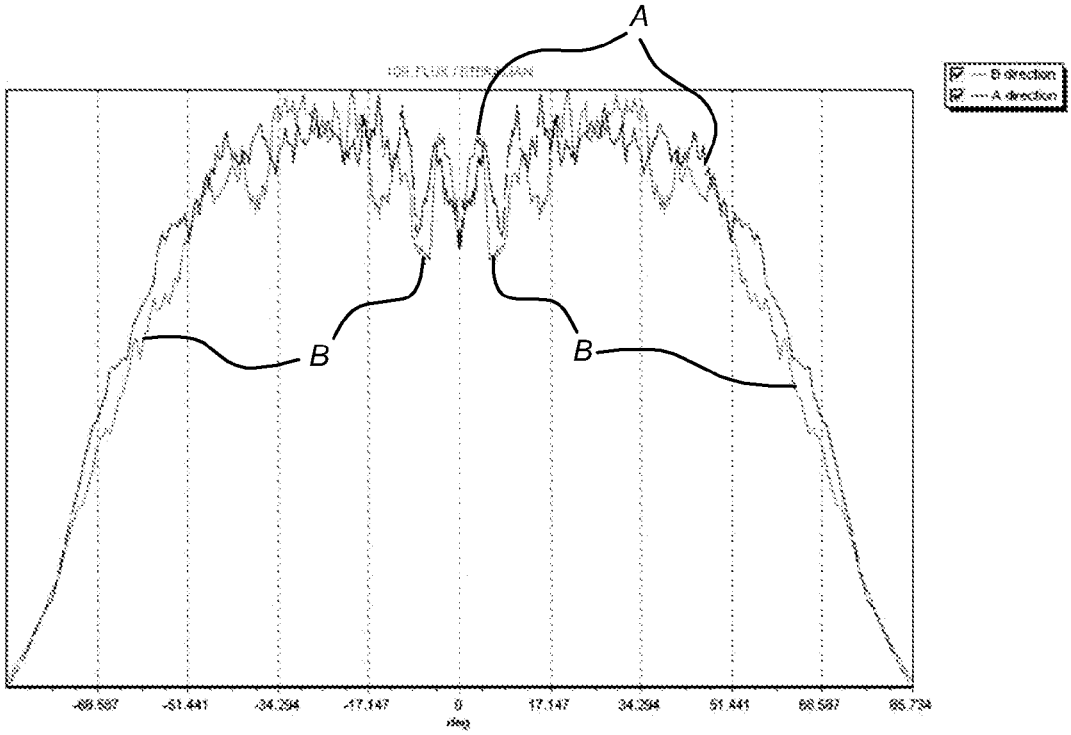
Figure 3E:
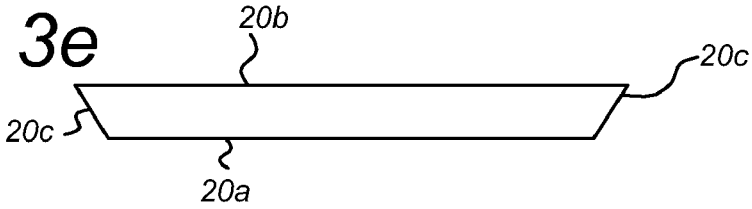

First, an OLED 20 having rectangular edges 20*c* (FIG. 3*a*) is simulated (rectangular with respect to substantially parallel first and second faces 20*a* and 20*c*). In this case, the luminance on edges is three times higher than from the top surface 20*b* of OLEDs (FIG. 3*b*). The edge luminous intensity distribution is shown in FIGS. 3*c* and 3*d*. The A-direction is parallel to the y-axis, the B-direction is parallel to the x-axis and the C-direction is parallel to the z-axis (see also FIG. 4). This means that light 21 (essentially) comes from the edges 20*c*, and assuming an arrangement parallel to floor and ceiling, illuminates in two directions: in the direction of the ceiling and of the floor. Likewise, this will apply to window panes 40 including the one or more OLEDs 20. Then, OLED light 21 will leave the pane 40 at all surfaces 40*a*, 40*b* and 40*c*, but preferentially at the side surfaces or edges 40*c*. Edges 40*c* are the edges of the window pane 40 which are arranged substantially perpendicularly to the organic layer; edges 40*a* and 40*b* are the external faces of the pane 40, respectively, which are substantially parallel to the organic layer 22 in OLED 20; i.e. the front and back face, respectively, of the OLED 20.

Figure 3F:
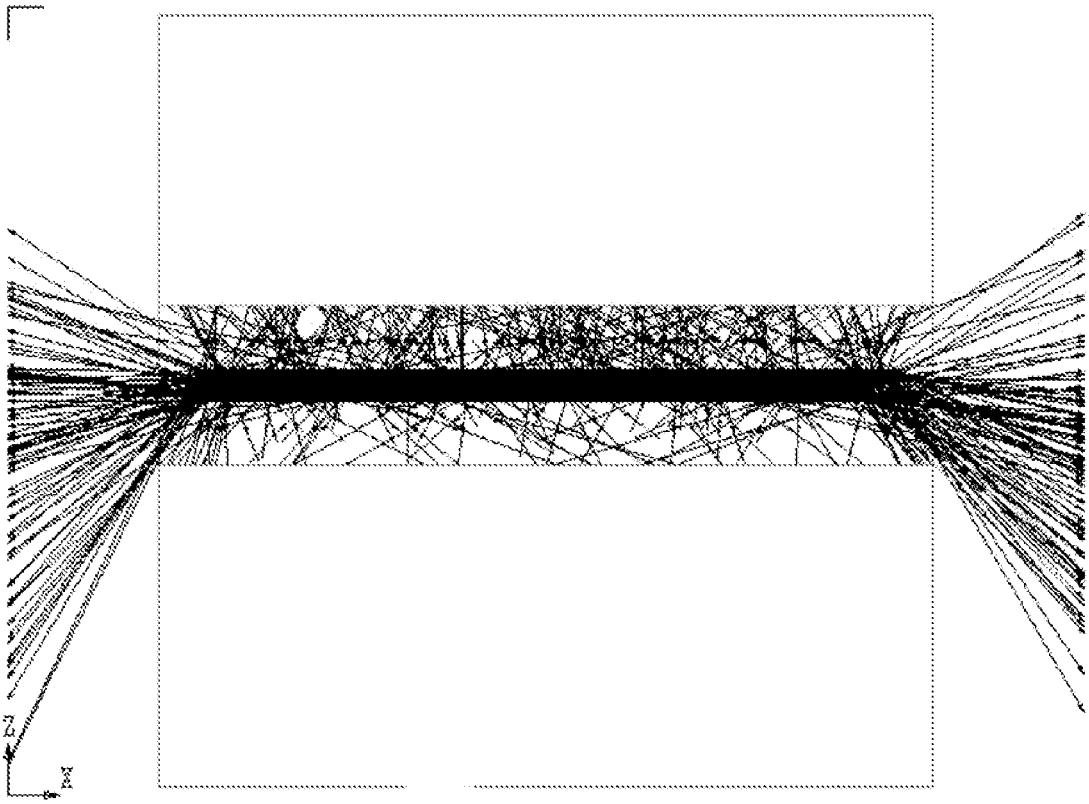
Figure 3G:
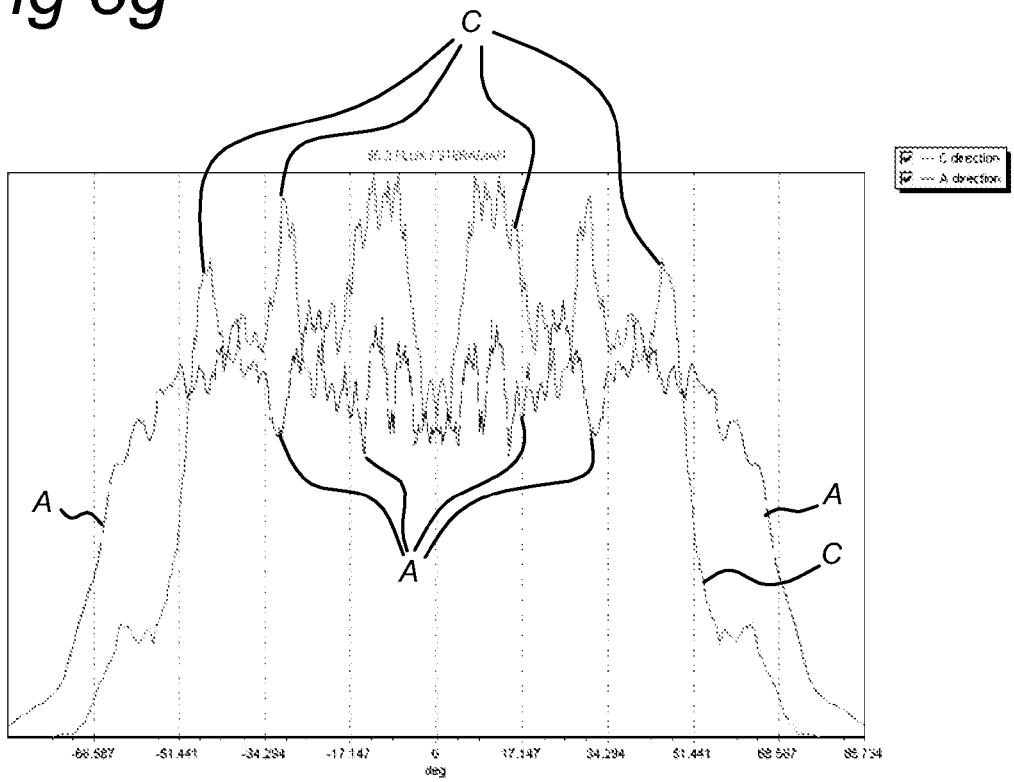
Figure 3H:
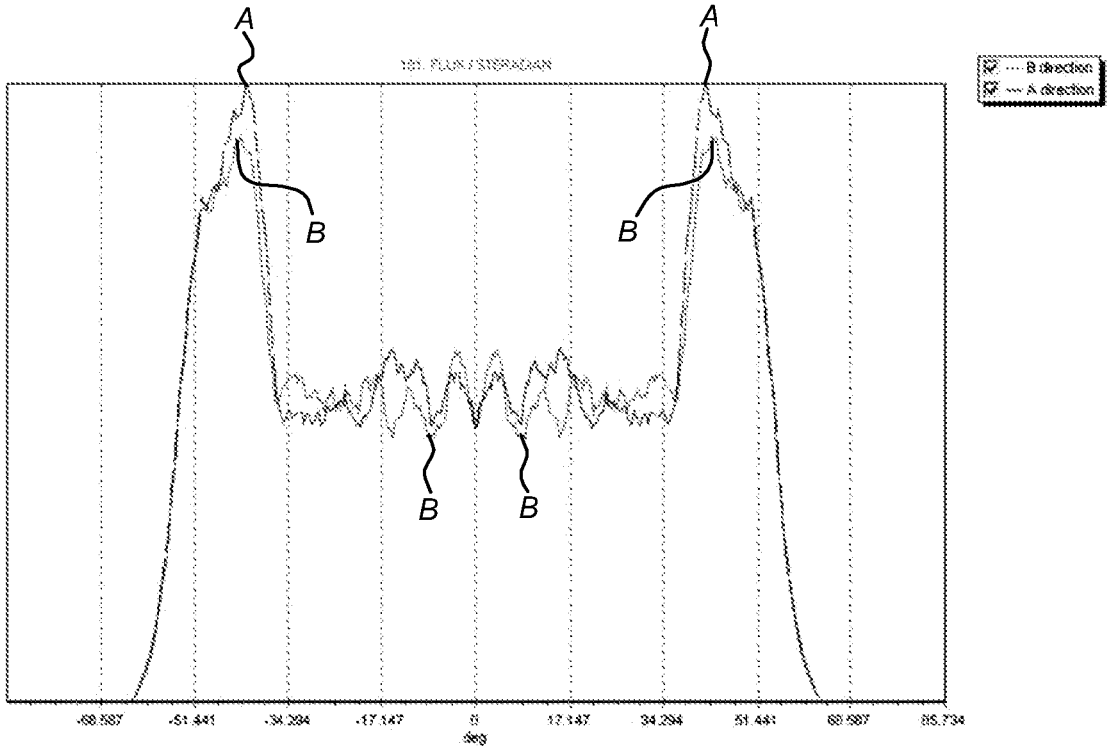

In a preferred embodiment, however, OLEDs 20 having one or more tilted edges 20*c* are applied, as is schematically depicted in FIGS. 2*c* and 3*d*. This also includes window panes 40 having one or more tilted edges 40*c*, as is schematically depicted in FIG. 2*d*. FIG. 2*d* schematically depicts a window pane 40 comprising a plurality of OLEDs, which are integrated in a transparent material. The front and back faces 40*a* and 40*b* are essentially parallel to the organic layer or layers 20 of the OLED or OLEDs. The edge or edges 40*c* of window pane 40 may be tilted at an angle α. This means that window panes 40, in and/or on which one or more OLEDs 20 are provided, may include tilted edges 40*c*. Ray-tracing results of OLEDs having tilted edges 20*c* are shown in FIGS. 3*f*, 3*g* and 3*h* (edge luminous intensity distributions). In this case, the light substantially comes from OLEDs 20 and substantially illuminates either the ceiling or the floor at a certain angle. In this case, the luminance on edges 20*c* or 40*c* may be at least about three times higher than from the top surface 20*b* of OLEDs 20, but may even be higher. In FIGS. 3*f* and 3*h*, an OLED 20 is used with edges 20*c* having an angle α of about 45°; in FIG. 3*g*, α is slightly larger than 0°.

Figure 9:
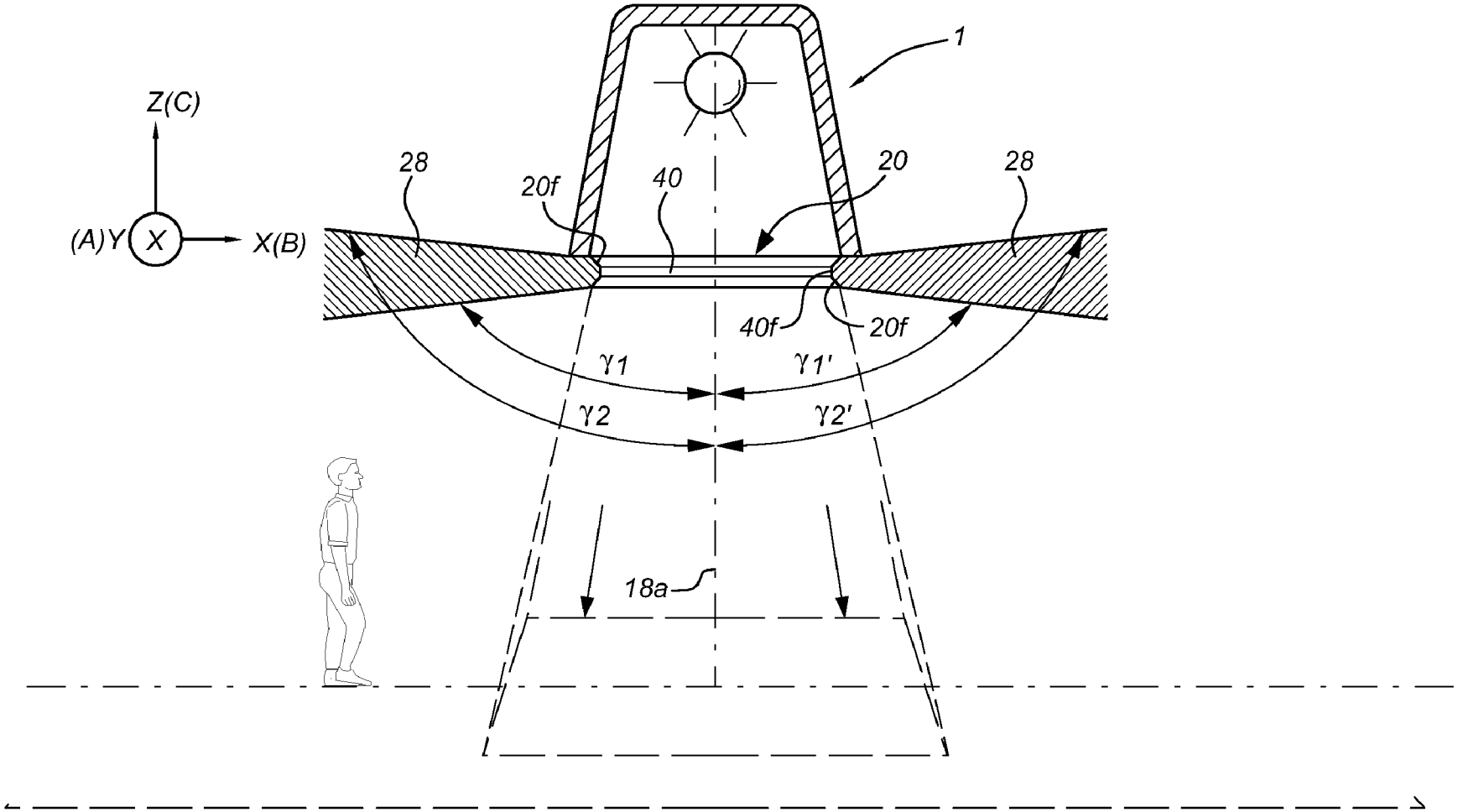
FIG. 9 is a schematic side view of yet another embodiment of the lighting device of the invention.

Hence, in a specific embodiment, a lighting device 1 is provided, which comprises at least one OLED 20 or a window pane 40 comprising at least one OLED 20, wherein the at least one OLED or the window pane 40 comprising the at least one OLED 20 is arranged to emit light 21 substantially at edge 20*c* or 40*c*, respectively. The term "substantially" herein refers to the situation in which at least 50% of the total flux of light 21 leaving the OLED 20 (or the window pane 40) leaves from the total external surface of these edges. Edges 20*c* and 40*c* relate to edges of the OLED or the window, which are perpendicular to the plane of the organic layer 22, respectively, or optionally tilted. Alternatively or additionally, the edges have an end surface 20*f*, 40*f* which has a concave, convex or undulated shape along a normal 18*a* normal to the OLED 20, as is shown in FIG. 9. In this way, a desired designed beam shape is obtained, which is suitable for special decorative illumination or illuminative effects. In FIGS. 2*c* and 2*d*, angle α reflects the tilt of the edges 20*c* and 40*c*. In FIG. 2*a*, this angle α is 0°; α is preferably larger than 0° and smaller than 90° (1), or larger than 90° and smaller than 180° (2). Assuming a configuration in which the organic layer or layers 22 are substantially parallel to a ceiling (or floor), the former configuration (1) is advantageous for preferentially illuminating objects arranged below the device 1, such as, for instance, a floor, and the latter configuration (2) is advantageous for preferentially illuminating objects arranged above the device 1, such as, for instance, a ceiling. In this way, a device 1 is provided in which the beam 18 of light 11 generated by the at least one lamp 10 and the beam 28 of light 21 generated by the at least one OLED 20 may leave the device 1 in an angularly separated way. As can be seen in FIGS. 3*b*, 3*c* and 3*d*, on the one hand, and FIGS. 3*f*, 3*g* and 3*h*, on the other hand, the use of a tilted edge 20*c* or 40*c* leads to an increase and/or a redistribution of the light that escapes from edge 20*c* or 40*c*. For instance, the relative symmetric distribution of light in an upward and downward direction in FIG. 3*b* (tilt α=0) is changed in a distribution of FIG. 3*f* with relatively more light directed downwards when using tilted edges.

For the sake of understanding, further reference is made below to window pane 40 only, which, as described above, may consist of one or more OLEDs 20 (see also above), or may comprise the one or more OLEDs 20.

Hence, in an embodiment, the window pane 40 has at least one edge 40*c* which is tilted at angle α (tilt angle) relative to a normal to the at least one OLED 20, wherein $0° < \alpha < 90°$ or $90° < \alpha < 180°$. This normal is substantially parallel to a normal to front and bottom faces 40*a* and 40*b* (or 20*a* and 20*b*), respectively. In FIGS. 2*b* and 2*d*, both drawn edges (edges 20*c* in FIG. 2*b* and edges 40*c* in FIG. 2*d*, respectively) have a tilt angle α. The tilt angle α may differ for each edge 40*c*. The window pane may be circular and have one edge 40*c*, or may have different shapes such as triangular, square, rectangular, etc. One or more of the edges may have the same tilt angle α. However, α may also vary along the edge or edges 40*c*. In systems with an even number of edges 40*c* (≧2), wherein at least two edges 40*c* are arranged opposite each other, these opposite edges (20*c*) may be tilted independently at angle α. The term "independently" herein refers to the arrangement in which the tilt angle α may be the same for the opposite edges 40*c*, but may of course also not be the same. Tilt angle α may vary over the edge or edges 40*c*. This means that when there is more than one edge 40*c*, different edges 40*c* may have different tilt angles α, and/or one (circular) or more (triangular, square, rectangular, etc.) edges have a changing tilt angle α. Assuming rectangular or square panes 40, two opposite edges 40*c* are preferably tilted independently at tilt angle α, both preferably having the same tilt angle α.

Figure 4:
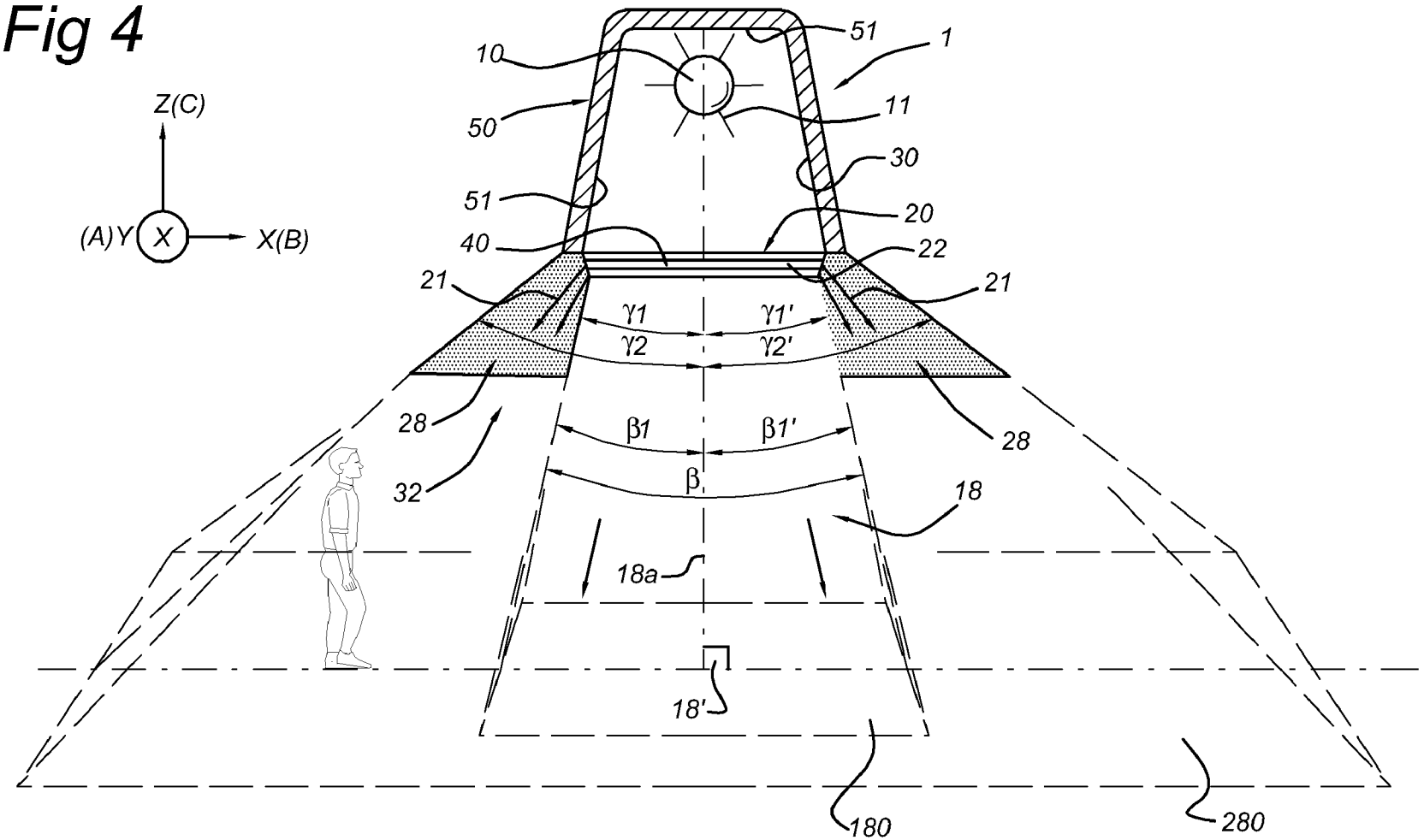
FIG. 4 is a schematic side view of another embodiment of the lighting device of the invention.

FIG. 4 shows a specific embodiment of a lighting device 1 in which beam 18 has a normal 18*a* to window pane 40 and beam 18 is substantially confined to a beam at an angle β1 relative to the normal 18*a* to window pane 40, and in which the at least one OLED 20 is arranged to generate light 21 into a beam 28, the OLED beam 28 being substantially confined to a beam having a smallest angle γ1 with respect to a normal

18*a* to window pane 40 and a largest angle γ2 with respect to a normal 18*a* to window pane 40. In fact, normal 18*a* is a normal to OLED 20 (or a normal to organic layer 22). Hence, γ2>γ1; γ2>0°; preferably γ2≧β1 (in FIG. 4, γ2 is larger than β1); γ1>0°; β1>0°.

Here, a substantially flat window pane 40 is shown, but in other embodiments, the window pane 40 comprising the one or more OLEDs 20 may also be curved. As will be clear to the person skilled in the art, window pane 40 may also comprise a plurality of window panes, one or more of which comprise one or more OLEDs 20.

FIG. 4 assumes a symmetric light distribution relative to the normal 18*a,* wherein angles β1=β1', γ1=γ1' and γ2=γ2'. Herein, γ2>γ1. Unless otherwise indicated, a substantially symmetric light distribution is assumed (mirror symmetry; see also FIGS. 8*a,* 8*b* and 8*d*). Furthermore, FIG. 4 assumes a horizontal arrangement of lighting device 1, i.e. window pane 40 is substantially parallel to the floor and ceiling. As will be clear to the person skilled in the art, the invention is not limited to such an arrangement. When, in FIG. 4, the observer would be positioned at 18' and then move to the left or the right, he would experience substantially similar light distributions, see also FIGS. 3*b*, 3*c*, 3*d*, 3*f*, 3*g* and 3*h;* likewise, the observer moving to the back or standing up might again experience substantially similar light distributions. Hence, when referring to β1, γ1 and γ2, reference is also made to β1', γ1' and γ2', respectively, below, unless otherwise indicated. Note that these angles refer to a two-dimensional description of beams 18 and 28, i.e. in the plane of X (or B) and Z (or C). As is known to the person skilled in the art, the light distribution in the plane of Y (or A) and Z (or C) may differ from the former (see also below in the description of FIGS. 8*a* to *d*).

Furthermore, FIG. 4 schematically depicts an embodiment in which lighting device 1 is arranged as, for instance, a TL lamp in a luminaire. As can be seen in FIG. 4 (but also FIGS. 5 and 7) most of the light 32 is directed downwards. Hence, angle 18' is a right angle, which, in this substantially horizontal arrangement, can also be indicated as "nadir".

In the schematic FIG. 4, which depicts one of the possible embodiments of the invention, two distinct lighting areas can be observed, one area 180, which is substantially illuminated by beam 18 confined by angle β1 (here β1=β1'), and another area 280, wherein lumination from the at least one OLED 20 is received in the form of beam 28 confined by angle γ2 (here γ2=γ2'). As will be clear to the person skilled in the art and, for instance, also from FIGS. 3*b*, 3*c*, 3*d*, 3*f*, 3*g* and 3*h*, the at least one OLED 20 may also irradiate at angles smaller than γ1 (and γ1') in case γ1≠0°. However, especially in the case in which α is smaller than 90° and larger than 0°, the flux between angles γ1 (wherein γ1≠0°) and γ2 may be even more enhanced relative to the areas confined to γ1 (see FIG. 3*h*).

The angles γ2 and β1, and in an embodiment also angle γ1 especially refer to cut-off angles. The term cut-off angle is known to the person skilled in the art and refers to the angle formed by a line drawn from the direction of the direct light (i.e. beams 18 and 28, respectively) at the light source with respect to a vertical (here the dash-dotted line to 18'), beyond which no direct light is emitted. The phrase "beyond which no direct light is emitted" is to be understood in the sense of European Standard EN I 12464-I (-SC/02168, revised Dec. 11, 2002), wherein the limit is set at a luminance of ≦1000 cd/m$^2$. Hence, γ2 and γ1, or γ2 alone when γ1=0°, define beam 28 in a preferred embodiment, wherein, at angles smaller than γ2 (and larger than γ1 in case γ1≠0°), the at least one OLED 20 of lighting device 1 provides a luminance of more than 1000 cd/m$^2$, and at angles equal to or larger than γ2 and equal to or smaller than γ1 (if γ1≠0°), the at least one OLED 20 of lighting device 1 provides a luminance of ≦1000 cd/m$^2$. Likewise, β1 defines beam 18 in a preferred embodiment, wherein, at angles smaller than β1, the at least one lamp 10 of lighting device 1 provides a luminance of more than 1000 cd/m$^2$ and at angles equal to or larger than β1, the at least one lamp 10 of lighting device 1 provides a luminance of ≦1000 cd/m$^2$. Hence, when the lighting device 1 in this embodiment is in operation and an observer views the device 1 at a viewing angle equal to or larger than γ2, a luminance of the at least one OLED 20 and the at least one lamp 10 will be ≦1000 cd/m$^2$. When the viewing angle is reduced and becomes smaller than γ2, but larger than γ1 (if y≠0°), an OLED luminance of more than 1000 cd/m$^2$ will be observed. At angles smaller than β1, a lamp 10 luminance of more than 1000 cd/m$^2$ will be received.

Hence, in an embodiment of the lighting device, the at least one lamp 10 is arranged to generate light 21 into first beam 18, and the at least one OLED 20 is arranged to generate light 21 into second beam 28, wherein, relative to the normal to the at least one OLED 20, the first beam 18 has a cut-off angle β1 and the second beam has a cut-off angle γ2 and optionally a cut-off angle γ1, and γ2>γ1, preferably γ2≧β1. At angles≧β1, the luminance of the lighting device 1 due to the first beam 18 and, at angles≧γ2, the luminance of the lighting device 1 due to the second beam 28 are preferably independently ≦1000 cd/m$^2$. At angles<β1, the luminance of the lighting device 1 due to the first beam 18 and, at angles<γ2 (and larger than if y≠0°), the luminance of the lighting device 1 due to the second beam 28 are independently >1000 cd/m$^2$. When γ1≈0°, beam 28 has only one cut-off angle.

In a preferred embodiment, γ2>β1 (i.e. β1<γ2; β1>0°). In this way, a lighting device 1 can be provided, wherein the "core" beam 18 can be used, for instance, for illumination, and the light in beam 28 provides a lumination effect: a light effect may be created around the beam 18 of the at least one lamp 10, "similar" to a halo.

Especially in view of office applications, β1 is preferably chosen to be 0<β1≦65° so as to circumvent glare; in another embodiment, 0<β1≦55°, and in yet another embodiment, 0<β1≦30°. Assuming a lighting device 10 used as ceiling lighting in a general lighting application, when β1≦65°, and preferably ≦30°, glare is minimized. Since the OLED light 21 in beam 28 is generally weaker, glare by the OLED light 21 may be substantially absent. In an embodiment, γ1≧30°, preferably γ2≦65°. Preferably, γ2≧β1, more preferably γ2>β1. In yet a further embodiment, 0<β1≦10°; such a configuration can be used as "accent lighting", with the at least one lamp 10 providing a beam of light 18 at a relatively narrow angle β1.

In another preferred embodiment, γ1≧β1. Especially when γ1≦β1, or even more preferably when γ1>β1, the at least one OLED 20 is arranged to provide the second beam of light 28 substantially outside the first beam of light 18, as is indicated in FIG. 4. The phrase "second beam of light 28 substantially outside the first beam of light 18" will be clear to the person skilled in the art. It especially refers to a distribution of the light wherein the at least one OLED 20 substantially provides beam 28 in an area outside area 180. Such a configuration provides a device 10 with light 32 from the at least one lamp 10 and the at least one OLED 20, while outside the beam 18 of the lamp 10, the OLED light 21 will become visible (as "beam" 28) and luminance indication lighting can be obtained. In one embodiment, the angular distribution at which the OLED light 28 is dominant and thus visible is typical of shoppers looking for indication signs. By shaping the geometry of the OLED 20 (as defined above with respect to the tilted edges 20*c* and 40*c*, respectively), the angular flux distribution of the OLED light can even be tuned further to enhance the effect, as shown above. Hence, an embodiment of the invention provides a lighting device 1 wherein a difference between the angular flux distribution of the lamp 10 (which may be a traditional light source) and the OLED 20 can be achieved relatively easily, without relatively bulky or complicated optics. However, for any configuration in which $\gamma 2>\beta 1$, a lighting effect is created wherein the OLED light 28 is angularly separated from the lamp light 18 and is seen outside this beam 18.

In other embodiments, $\gamma 1 \leqq \beta 1$, and especially when also $\gamma 1=0°$, beams 18 and 28 at least partially overlap. Such embodiments may be used to provide, for instance, a color variation, when, for instance, the at least one OLED 20 is able to provide colored light. When, furthermore, also $\gamma 2>\beta 1$, the above-described combination of illumination by beam 18 and rumination from beam 28 can also be achieved.

In another embodiment, $\gamma 2=\beta 1$. When $\gamma 1=0°$ and $\gamma 2=\beta 1$, the beams 18 and 28 essentially overlap, i.e. beams 18 and 28 have substantially the same cut-off angles. When $\gamma 1 \neq 0°$ (i.e. $\gamma 1>0°$) and $\gamma 2=\beta 1$, the beams 18 and 28 overlap, but the intensity of beam 28 has a relative minimum at a normal 18*a* to window pane 40, see e.g. also FIG. 3*h*, which may show the luminous intensity of lighting device 1 with such an arrangement. Also these embodiments may be used to provide a color variation.

In again another embodiment, $2°<\gamma 2 \leqq 65°$, $0°<\beta 1 \leqq 30°$, and $\gamma 2>\beta 1$. Such an embodiment may be used for rumination (OLED light 21) with the lamp 10 as "accent light", especially when $0°<\beta 1 \leqq 10°$.

In another specific embodiment, $\gamma 2<\beta 1$. In this way, OLED light 21 of the at least one OLED 20 as beam 28 may be found within beam 18 of the at least one lamp 10. This may provide a "corona" effect of light 32. For instance, when the OLED 20 provides red light and the lamp 10 provides white light, a red-light red spot may be observed within beam 18.

As schematically shown in an alternative embodiment of the lighting device 1 in FIG. 9, the lighting device 1 has a concave surface 20*f* of the OLED 20 and a concave surface 40*f* of the window pane 40, respectively. This results in a narrow beam 28 in a direction almost perpendicular to the normal 18*a*, wherein $\gamma 1$ is about 80° and $\gamma 2$ is about 100° and $\gamma 1=\gamma 1'$ and $\gamma 2=\gamma 2'$.

Figure 7:
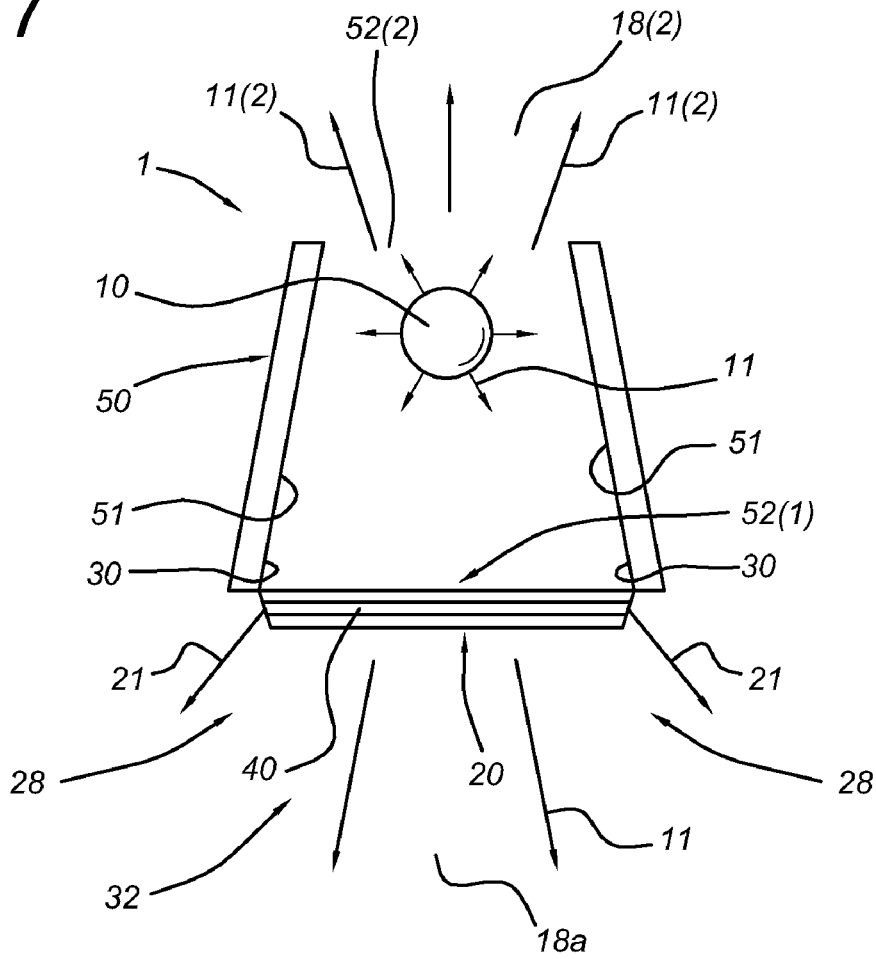
FIG. 7 is a schematic side view of yet another embodiment of the lighting device of the invention.

In yet another embodiment, as schematically depicted in FIG. 7, lamp 1 comprises two openings which are arranged to pass light 11 from the at least one lamp 10 through these openings in preferably different directions. In FIG. 7, lamp 1 comprises a first opening 52(1) and a second opening 52(2), which, in this embodiment, are opposite to each other, with respect to the at least one lamp 10. In this embodiment, the one or more beam manipulators 30 are preferably arranged to manipulate light 11 into two directions, i.e. in the direction of opening 52(1) and opening 52(2) in the beam manipulator 30 (here, the openings in housing 50). Hence, in another preferred embodiment, the invention provides a lighting device 1 which further comprises a first opening 52(1) and a second opening 52(2), wherein the at least one lamp 10 is arranged to provide at least 20%, more preferably at least 30% of the total flux of light 11 generated by the at least one lamp 10 in the direction of the first opening 52(1), and to provide at least 20%, more preferably at least 30% of the total flux of light 11 in the direction of the second opening 52(2). The fluxes through openings 52(1) and 52(2) may have ratios of, for instance, 100:0 (no opening, as discussed above), 80:20, 60:40, 70:30 and 20:80. The percentages of the fluxes add up to 100%. The first opening 52(1) is the opening which is indicated as opening 52 in FIGS. 4, 5 and 6. It is this opening which comprises the at least one OLED 20. As will be clear to the person skilled in the art, also the second opening 52(2) may comprise at least one OLED.

In the embodiment schematically depicted in FIG. 7, at least part of the light 11 escapes from the lighting device 1 via the second opening 52(2). The beam manipulator 30 may be arranged to reflect at least part of the total flux of the light 11 of the at least one lamp 10 downwards and to reflect at least part of the total flux of the light 11 of the at least one lamp 10 in another direction, typically upwards. This up/down light distribution may be used in suspended luminaries for lighting both the room below and the ceiling above. In this specific embodiment, the transparent OLED 20 can be located in the beam reflecting to the floor, in the beam directed to the ceiling, or in both. In these embodiments, the transparent OLEDs 20 thus only transmit part of the total flux of the one lamp 10. The invention is not limited to suspended lighting devices 1.

Hence, as will be clear to the person skilled in the art, one or more of the geometries of the housing 50, including the one or more openings 52, the arrangement of the at least one lamp 10 relative to the housing 50 and the optional presence of one or more beam manipulators 30 (and the arrangement of the lamp relative to the optional one or more beam manipulators 30), direct at least part of the total flux of the light 11 towards the at least one OLED 20 (comprised in opening 52(1)), and beam 18 is generated, while at least part of the total flux of light 11 escapes from the lighting device 1 via second opening 52(2).

As will be clear to the person skilled in the art, the openings 52(1) and 52(2) are interchangeable, for instance, instead of opening 52(1), opening 52(2) may comprise the at least one OLED 20. The preferred embodiments described hereinbefore with conditions for $\beta 1$, $\gamma 1$ and $\gamma 2$ refer to the one or more openings or windows 52 of lighting devices which are to be arranged to provide beam 18 substantially in the direction below the lighting device 1 when in use, especially in its prescribed use, such as opening 52(1) in FIG. 7 and opening 1 in FIGS. 4 and 5.

In yet another embodiment, the lighting device 1 according to the invention provides an asymmetric beam of the at least one lamp 10, for instance, for illuminating a wall (wall-washing application), and the OLED is used for guidance. Here, $\beta 1 \neq \beta 1'$, and either $\beta 1>\beta 1'$ or $\beta 1<\beta 1'$. For instance, $\beta 1$ may be about 0° and $\beta 1'$ may be about 80°. As will be clear to the person skilled in the art, this is equivalent to an embodiment wherein $\beta 1'$ may be about 0° and $\beta 1$ may be about 80°. One of $\beta 1$ and $\beta 1'$ is preferably <10° and the other one of $\beta 1$ and $\beta 1'>10°$, preferably >45°, more preferably between about 60° and 90°, and preferably less than about 85°. Whereas the light distribution of beam 18 may be asymmetric, the light distribution of beam 28 may still be symmetric, but also asymmetric. When, for instance, the tilt angle $\alpha$ varies over edge or edges 40*c* (i.e. changing a for one or more edges and/or different tilt angles $\alpha$ for two or more edges), an asymmetric beam 28 may be generated by the OLED 20 in operation. In a preferred embodiment, both $\gamma 2$ and $\gamma 2'$ preferably define beam 28, wherein (i.e. at angles smaller than $\gamma 2$ and $\gamma 2'$) the at least one OLED 20 of lighting device 1 provides a luminance of more than 1000 cd/m$^2$, and at angles equal to or larger than $\gamma 2$ and $\gamma 2'$, the at least one OLED 20 of lighting device 1 provides a luminance of $\leqq 1000$ cd/m$^2$. Preferably, $\gamma 2$ and $\gamma 2'$ are both independently smaller than about 65°.

Hence, in a specific embodiment, at least the first beam 18 has an asymmetric light distribution. In yet another embodiment, at least the second beam 28 has an asymmetric light distribution.

The lighting device 1 of the invention can be applied in any environment where general lighting and indication light may be needed, such as in shops, hospitals, clinics, offices, corridors, tunnels, indoor escape routes, gangways (in e.g. planes or coaches), elevators, escalators, hospitality areas such as pubs, restaurants, hotels, etc.

In a specific embodiment, such as, for instance, in shops, especially in high-ceiling shops, luminance lighting can be used to indicate areas with a certain shopping content, such as e.g. red for meat, green for vegetables, blue for fish. Nowadays, this requires installation of two lamp systems, namely, an illuminance system for general "shop" lighting and a luminance system for indication lighting. This problem can be solved by the device 1 of the invention. Hence, an embodiment of a hybrid OLED-lamp system as described herein as lighting device 1 combines the function of general lighting (by the traditional lamp or lamps/LED or LEDs) 10 and indication lighting by the OLED or OLEDs 20. Since the OLED or OLEDs 20 are substantially transparent, the two light sources 10, 20 are preferably placed over each other so as to minimize volume. For such applications, the at least one OLED 20 is arranged to generate colored light 21.

Figure 8A:
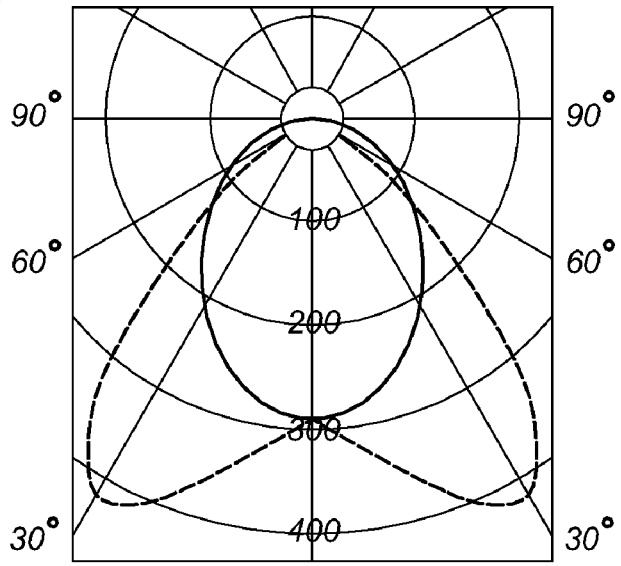
FIGS. 8*a*-*d* schematically depict specific light distributions that can be achieved with the lighting device of the invention.
Figure 8B:
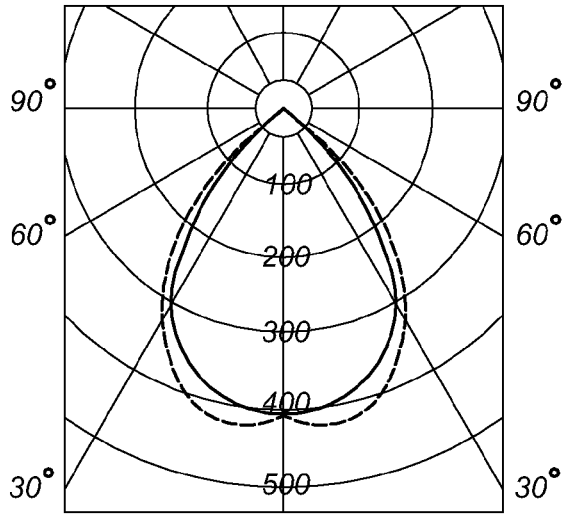
Figure 8C:
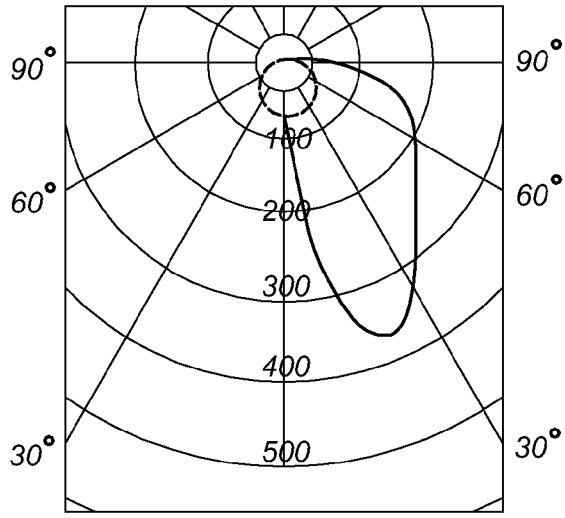
Figure 8D:
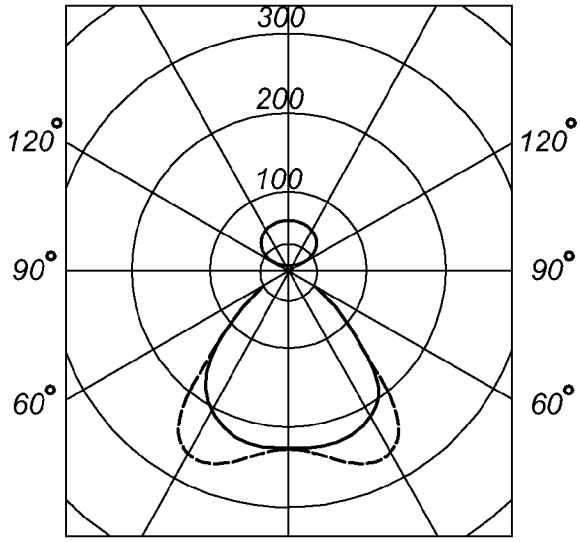

Examples of characteristic luminous intensity curves that may be achieved with lamps of the invention are schematically depicted in FIGS. 8*a* to 8*d*. In these Figures, the broken lines reflect the luminous intensity of the light in the y-direction, whereas the solid lines reflect the luminous intensity of the light in the x direction (see also FIG. 4). These Figures may especially relate to the light in beam 18; the light of the at least one OLED 20 in beam 28 may be distributed in the same but preferably different way, as described above. FIG. 8*a* typically depicts a fluorescent tube application (TL). When, in FIG. 4, lighting device 1 is a fluorescent tube, the observer moving along the x-direction will experience another light distribution than when moving along the y-direction. FIG. 8*b* schematically depicts a downlight application in which both distributions are substantially equal. In the latter case, the luminous intensity distribution may be similar in both directions. FIG. 8*c* schematically depicts a wall-washing application. Here, the light distribution is asymmetric, at least in one direction of the beam. In the invention, this may be especially beam 18. FIG. 8*d* finally depicts an application in which light also escapes from the top of lighting device 1.

The term "luminance" is known in the art and refers to a measure of the brightness of a surface. The terms "illuminance" and "illumination" are also known in the art and refer to the amount of light incident on a surface.

Figure 5:
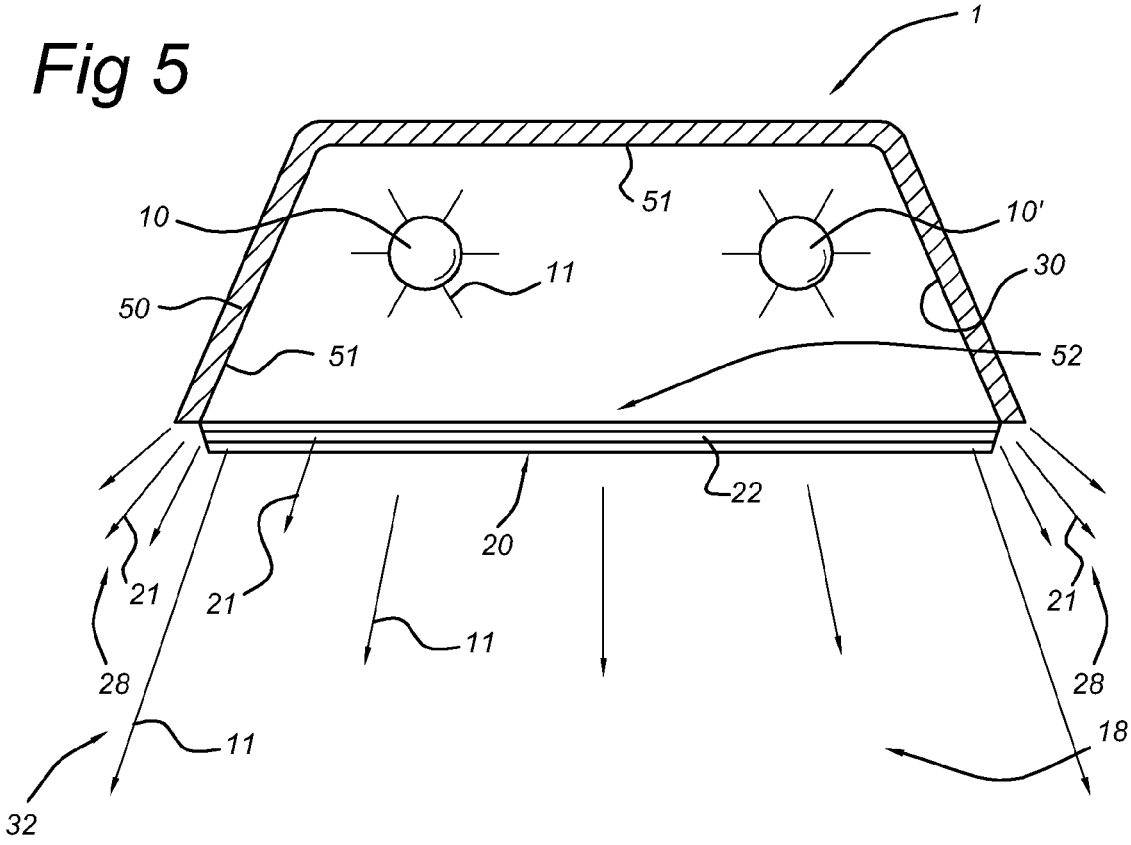
FIG. 5 is a schematic side view of yet another embodiment of the lighting device of the invention.

As mentioned above, the term "at least one lamp 10" may also include a plurality of lamps. An embodiment thereof is schematically shown in FIG. 5. In this Figure, two lamps are applied as "lamp" 10. Such luminaires are often used in office lighting. Likewise, a plurality of LEDs may be used.

The lighting device 1 as schematically depicted in FIGS. 1, 4, 5 and 7 may have further features which are not shown, such as louvers for (further) manipulation of beam 18 and/or beam 28. In addition or next to louvers, the lighting device 1 may comprise elements arranged to substantially block OLED light 28 in at least one direction. Since OLED light essentially escapes in two directions from edge 20*c* or 40*c*, respectively, one of these directions may be blocked. With particular reference to FIGS. 3*b*/3*c* and 3*f*/3*g*, it may be interesting to block at least part of the light that is emitted upwards. Likewise, the lighting device 1 may also comprises elements for blocking at least part of the light 11 of the at least one lamp, such as a reflector as is sometimes used in spot lights.

In yet another embodiment, which is schematically depicted in FIG. 6, the at least one OLED 20 can be arranged on a tubular fluorescent tube (TL) or fluorescent lamp, herein denoted by reference numeral 10. The OLED or OLEDs 20 may be wrapped, folded, coated or attached to the outer surface of the lamp 10. Such a lighting device 1 has, inter alia, the advantage that the light 32 emitted by the device 1 can be modulated by selecting the intensity and/or color of the OLED. For instance, the at least one OLED 20 may modify the white light 11 of a fluorescent lamp to colored light. Such a lighting device may also be a kind of multi-purpose lighting device 1, which combines the functionalities of providing light 11 for illumination and light 21 for rumination, depending on the desired application.

The lighting device may further comprise a controller (not shown) for controlling the light intensity and optionally the color of one or more light sources 10, 20. This may include controlling the intensity or color of individual light sources of a plurality of light sources, which form the at least one lamp 10, and/or the intensity or color of individual OLEDs of a plurality of OLEDs which form the at least one OLED 20. The controller may be an "only hardware" system with, for instance, switches such as touch controls, slide switches, etc. for controlling the intensity of light sources 10, 20 or selecting the desired color, depending on the application of lighting device 1, the user's mood, etc. Furthermore, the intensity and/or color of light source 10, 20 may depend on external parameters such as time, temperature, light intensity of external sources (such as the sun), which may be measured by sensors (not shown). The controller may be operated via a remote control. The controller may control the intensity of one or more light sources 10, 20 via means known in the art to control such light sources, such as ballasts.

In yet another embodiment, the controller may comprise a memory, with executable instructions, and an input-output unit, configured to:

(i) receive one or more input signals from one or more elements selected from the group of:
   (1) one or more sensors; and
   (2) a user input device; and
(ii) send one or more output signals to control the intensity and/or color of one or more light sources 10, 20; and a processor designed to process the one or more input signals into one or more output signals based on the executable instructions.

The controller may provide one or more functions of, inter alia, switching on and off one or more first light sources 10 and second light sources 20; determining the intensity of light 11; determining the intensity of light 21; determining the intensity of light 32; determining the color of light 11; determining the color of light 21; determining the color of light 32; determining whether or not one or more colors or intensities of light of one or more of light 11, light 21 and light 32 depend on one or more external parameters such as time, temperature, light intensity of external sources, etc.

It should be noted that the terms "top" and "bottom", and "left" and "right" are interchangeable.

The embodiments described hereinbefore illustrate rather than limit the invention, and those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer.

In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A lighting device, comprising:

at least one lamp arranged to generate first light; and a window pane comprising at least one OLED arranged to generate second light and to transmit at least part of the first light, wherein the at least one lamp is arranged to generate the first light into a first beam and the at least one OLED is arranged to generate the second light into a second beam, first and second beams leaving the lighting device at different angles.

2. The lighting device according to claim 1, wherein the at least one lamp is selected from the group consisting of: filament lamps, fluorescent lamps, luminescent tubes, halogen lamps, low-pressure gas discharge lamps, high-pressure gas discharge lamps, LEDs and OLEDs.

3. The lighting device according to claim 1, wherein the at least one OLED is selected from the group of PolyLEDs and small-molecule OLEDs.

4. The lighting device according to claim 1, wherein the at least one lamp is arranged to illuminate at least part of the at least one OLED with at least 40% of the total flux of the first light.

5. The lighting device according to claim 1, further comprising a beam manipulator comprising at least one reflector and/or at least one collimator and arranged to manipulate at least part of the first light and illuminate at least part of the at least one OLED with manipulated light.

6. The lighting device according to claim 1, wherein the window pane has at least one edge tilted at angle $\alpha$ relative to a normal to the at least one OLED, wherein $0° < \alpha < 90°$ or $90° < \alpha < 180°$.

7. The lighting device according to claim 1, wherein, relative to a normal to the at least one OLED, the first beam has a cut-off angle $\beta\mathbf{1}$ and the second beam has a cut -off angle $\gamma\mathbf{2}$ and wherein $\gamma\mathbf{2} \geqq \beta\mathbf{1}$.

8. The lighting device according to claim 7, wherein, at angles$\geqq\beta\mathbf{1}$, the luminance of the lighting device due to the first beam and, at angles$\geqq\gamma\mathbf{2}$, the luminance of the lighting device due to the second beam are independently $\leqq 1000$ cd/m$^2$.

9. The lighting device according to claim 7, wherein $0° < \beta\mathbf{1} \leqq 65°$.

10. The lighting device according to claim 7, wherein $2° < \gamma\mathbf{2} < 65°$, $0° < \beta\mathbf{1} < 30°$, and $\gamma\mathbf{2} > \beta\mathbf{1}$.

11. The lighting device according to claim 7, wherein at least the first beam has an asymmetric light distribution.

12. The lighting device according to claim 1, wherein the at least one OLED has a transmission of at least 70% for visible light of the at least one lamp.

13. The lighting device according to claim 1, wherein the window pane comprises a glass plate having the at least one OLED arranged thereon.

* * * * *